United States Patent [19]

Lagerstedt et al.

[11] Patent Number: 4,798,296

[45] Date of Patent: Jan. 17, 1989

[54] PACKING CONTAINER PROVIDED WITH A RECLOSABLE OPENING ARRANGEMENT

[75] Inventors: Jan Lagerstedt; Kjell Märtensson, both of Malmö , Sweden

[73] Assignee: AB Tetra Pak, Lund, Sweden

[21] Appl. No.: 27,569

[22] Filed: Mar. 18, 1987

[30] Foreign Application Priority Data

Mar. 26, 1986 [SE] Sweden ..... 8601396

[51] Int. Cl.[4] ..... B65D 5/70

[52] U.S. Cl. ..... 206/631.2; 206/628; 220/270; 229/125.15; 229/125.42

[58] Field of Search ..... 229/7 R, 17 R, 125.15, 229/125.42; 206/628, 629, 631, 631.1, 631.2; 220/260, 270, 359

[56] References Cited

U.S. PATENT DOCUMENTS

| | | | |
|---|---|---|---|
| 2,858,060 | 10/1958 | Kuchler | 229/51 |
| 3,650,458 | 3/1972 | Rausing | 229/17 R |
| 3,658,238 | 4/1972 | Nedstedt | 229/611 |
| 3,687,352 | 8/1972 | Kalajian | 229/48 T |
| 3,977,591 | 8/1976 | Martensson et al. | 229/7 R |
| 4,113,103 | 9/1978 | Carlsson | 206/611 |
| 4,126,263 | 11/1978 | Martensson | 229/17 R |
| 4,197,949 | 4/1980 | Carlsson | 206/611 |
| 4,585,498 | 4/1986 | Lagerstedt et al. | 220/270 |
| 4,595,116 | 6/1986 | Carlsson | 220/359 |

FOREIGN PATENT DOCUMENTS

| | | |
|---|---|---|
| 0001134 | 3/1979 | European Pat. Off. . |
| 206616 | 8/1966 | Sweden . |
| 214141 | 7/1967 | Sweden . |
| 1397915 | 6/1975 | United Kingdom . |

*Primary Examiner*—Stephen Marcus
*Assistant Examiner*—Gary E. Elkins
*Attorney, Agent, or Firm*—Burns, Doane, Swecker & Mathis

[57] ABSTRACT

A packing container is provided with an opening arrangement which comprises a hole (9) included in the container wall (7) and weakened areas designed and located so that the wall section between the weakened areas forms a tongue (10) projecting into the hole (9). The hole is closed by a cover strip (11) fitted over the hole and sealed to the container wall.

8 Claims, 1 Drawing Sheet

PACKING CONTAINER PROVIDED WITH A RECLOSABLE OPENING ARRANGEMENT

FIELD OF THE INVENTION

The present invention relates generally to packing containers and more particularly, to an opening arrangement in a packing container wall for forming an emptying opening.

BACKGROUND OF THE INVENTION

It is customary at present to use packages of non-returnable character for a large number of goods, and among them for liquid goods such as milk and similar dairy products, fruit juices, mineral water etc. The demand made on these consumer packages is that they should be inexpensive, easy to manufacture, distribute and handle and, not least, easy to open so that the contents can be made accessible in a convenient manner if required. In certain cases it is desirable also that it should be possible to reclose the package in a simple and effective manner once it has been opened.

A large group of these non-returnable packages, e.g. milk and fruit juice, consists of a rigid carrier layer of paper or cardboard which on at least one side has a coating of a plastic material which provides the package with the required liquid tightness and other necessary barrier properties, e.g. gas-tightness, and at the same time makes possible tight and durable sealing joints, in that combined layers of plastic material are heated and at the same time pressed against one another so that a fusing together of the combined plastic layers is obtained. Since most packages of this type during handling can come into contact with a moist environment it is customary, moreover, for the outsides of the packages also to have a plastic layer which prevents moisture from penetrating into the fibrous base layer which, if it became moist, would lose its mechanical rigidity, causing the package to feel soft and unmanageable.

Non-returnable packages of the abovementioned type can be manufactured today in high-capacity packing machines, where the contents are treated at the same time in a hygienic manner, and with the help of which even previously sterilized contents can be packaged under aseptic conditions in such a manner that the contents retain their sterility in the closed package during a very long period.

A well-known packing container for liquid foodstuffs contents of the type described in the introduction is the parallelepipedic container of the Tetra Brik type (registered trade mark) which customarily is manufactured from plastic-coated paper or similar packing laminate which through conventional folding and sealing operations in a packing machine of known type is formed, filled and closed so as to form finished parallelepipedic containers. Such a container often has a prepared emptying opening in the form of a hole punched out in the top side of the packing container, preferably at a corner edge, which is covered on the outside by a tear-off cover strip sealed to the package wall. The container is opened in that the strip covering it in this manner is pulled upwards and backwards so as to expose the said emptying opening.

The known packing container described certainly has a number of important advantages both from a manufacturing aspect as well as from a point of view of the user. It is simple, inexpensive and easy to manufacture in rapidly producing packing machines and also easy to distribute and to store. Moreover the container is easily openable and allows a flow of the contents in a well-defined jet. One disadvantage of the known container, however, is that it still lacks the reclosability desired from the side of the consumer which means that the emptying opening once exposed should be capable of being closed again and thus present the possibility of a "safe" storage of the contents between different pouring events.

OBJECTS AND SUMMARY OF THE PRESENT INVENTION

It is an object of the present invention, therefore, to overcome the said disadvantage of the known packing containers and consequently produce a packing container of the type described in the introduction which has the advantageous properties of the containers described, but which in contrast to these permits, moreover, a simple and effective reclosing of the package once opened.

This object as well as other objects that are apparent from the following description of the invention are achieved in accordance with the p invention in that a packing container of the type described in the introduction has been given the characteristic that the package wall includes weakened areas of such a design that the wall section present between these weakened areas forms a foldable tongue projecting into the hole, and that the hole is closed by a cover strip fitted over the hole which is sealed to the package wall around the contour of the hole.

BRIEF DESCRIPTION OF THE DRAWING

The invention will be described in detail in the following with reference to the attached drawing, wherein.

DETAILED DESCRIPTION OF A PREFERRED EMBODIMENT

Figure 1A:
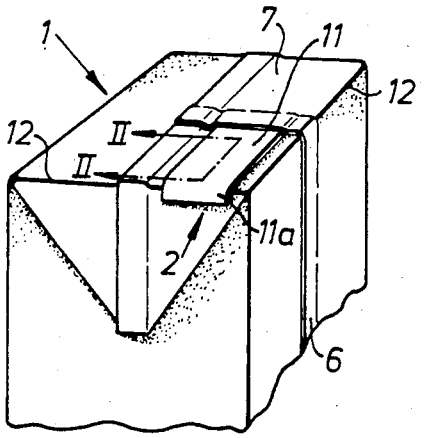
FIG. 1*a* is a perspective view of a top part of a packing container known in itself and provided with an opening arrangement in accordance with the invention.
Figure 2:
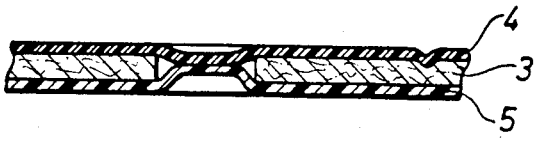
FIG. 2 is a cross-sectional view along the line II—II in FIG. 1*a*.

In FIG. 1*a* is shown a packing container 1, known in itself, in closed condition which has been provided with an opening arrangement 2 in accordance with the present invention. The packing container 1 is of the Tetra Brik type (reg. trade mark) which may be manufactured from a packing laminate which in the example, specially shown in FIG. 2, has a base layer 3 consisting of paper, cardboard or similar fibrous material which on the outside and inside is coated with liquid-tight layers 4 and 5 respectively of plastic material, e.g. polyethylene. In order to raise further the barrier properties of the packing laminate it may be necessary sometimes that it should also comprise a gas-tight material, e.g. metal foil or a plastic material with good gas-tightness properties. This layer in turn may be coated with further layers of plastic material, e.g. polyethylene, facing towards the inside of the packing container 1.

The packing laminate is supplied in form of a web to a packing machine 1 and is folded and sealed along a so-called ovelap joint 6 so as to form a liquid-tight tube which is filled with the desired contents. Subsequently the tube is processed with the help of sealing jaws which at equal intervals flatten the material tube so that its walls rest against each other in narrow transverse zones. With the help of the sealing jaws the material is heated in the zones, as a result of which a surface fusion of the thermoplastic layers on the inside of the material tube pressed against each other will be achieved, dividing the material tube into separate liquid-tight packing containers. Subsequently the packing containers are separated from one another through transverse cuts in the sealing zones, whereupon they are subjected to a form processing which converts the packing containers to the parallelepipedic shape shown. As is evident from FIG. 1*a*k –1*c* the opening arrangement 2 in accordance with the invention can be located in the top wall 7 of the container 1, preferably in a corner region so as to facilitate the pouring out of, for example, fluid contents when the container is to emptied of its contents.

In the example shown in the opening arrangement 2 has a weakened area 8 arranged in the container wall 7 in the form of two straight parallel cut lines 8*a* in direct connection to a hole 9 included in the container wall 7. The weakened area 8 is designed so that the wall section present between the two said cut lines 8*a* forms a foldable tongue 10 projecting into the hole 9. The hole 9 as well as the said tongue 10 are covered in closed condition of the container 1 (FIG. 1*a*) by a cover strip 11 applied to the outside of the container which is sealed to the package wall 7 around the contour of the hole 9. As will be explained further on, the seal between the cover strip 11 and the package wall 7 is stronger in the area of the tongue 10 than in the remaining sealing area situated around the hole 9. This can be achieved in accordance with the invention through the seal, for example, comprising a larger surface within the area of the tongue 10.

Figure 1B:
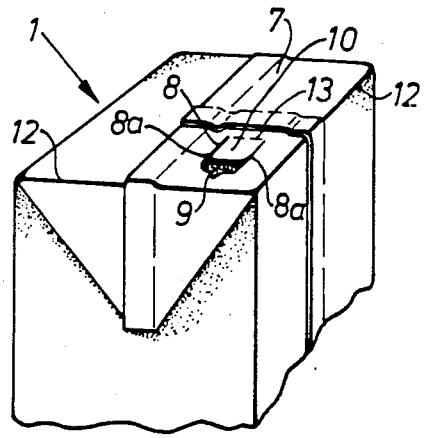
FIG. 1*b* is a perspective view of the same packing container as shown in FIG. 1*a*, but with the cover strip removed.

The hole 9 as well as the weakened area 8 can be produced preferably in the base layer 3 of the packing laminate before the same is coated with the inner plastic layer 5 and the remaining laminate layers facing towards the inside of the container 1. This brings with it the advantage that the packing material will be liquid-tight, since the hole 9 and the weakening 8 are covered by plastics from the inside of the container 1. In order to facilitate the tearing off of the cover strip 11 on opening of the container 1, the cover strip 11 appropriately has a free end 11*a* serving as a pull-tab which in the example shown is sufficiently long to reach over and around one of the delimiting lines 12 of the top side 7 of the container 1 situated close to the hole 9. As indicated in FIG. 1*b* the ends of the two straight cut lines 8*a* remote from the hole 9 are joined to each other through a crease line 13 arranged in the package wall 7, with the help of which the resistance against the folding up of the tongue 10 is diminished because of the mechanical rigidity of the plastic-coated base layer 3, with the consequence that the tearing off of the cover strip 11, firmly sealed to the tongue 10, is facilitated to a corresponding degree. In order to prevent total tearing off of the cover strip 11 when the same is lifted and drawn backwards on opening of the container 1, the rear end of the cover strip 11 is preferably sealed underneath the overlap joint 6 on the top side 7 of the container produced during the forming of the container 1.

The design of the hole 9 is not critical for the concept of the invention, but the shape as well as the size may be varied and adapted to the actual contents which are to be packaged.

Figure 1C:
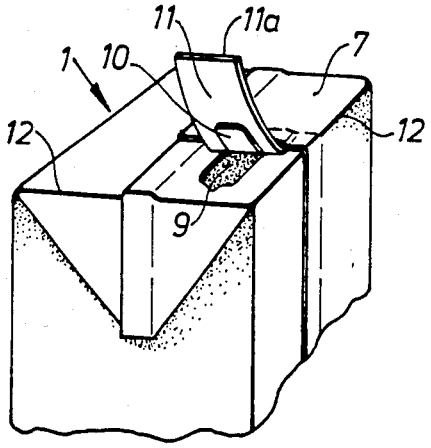
FIG. 1*c* is a perspective view of the packing container in an open condition.

When the closed container 1 shown in FIG. 1a is to be opened, the pull-tab 11*a* of the cover strip 11 is gripped, lifted and pulled backwards to the position shown in FIG. 1*c* to expose the hole 9 through tearing apart the inner plastic layer 5 sealed to the underside of the cover strip 11 along the contours of the hole 9 and folding up of the foldable wall tongue 10 firmly sealed to the cover strip 11. After the desired pouring out of the contents the container 1 is reclosed by returning or folding down the cover strip 11 to the closed position in FIG. 1*a*, an effective and durable reclosing being assured owing to the foldable tongue 10 snapping firmly into the container wall 7 along the cut edges 8*a* which are provided with a narrow fit.

Naturally the invention should not be regarded as being limited simply to the embodiment described above merely as an example, but a number of modified designs which are obvious to those versed in the art come within the scope of the concept of the invention and it is recognized that variations and changes may be made and equivalents employed herein without departing from the invention as set forth in the claims. For example, the weakened areas in the container wall need not be in the form of continuous cut lines wholly penetrating the container wall, but may instead consist of perforations in the form of holes or slots recurring at regular intervals located along two parallel straight lines, the ends of both of which are directly connected to the contour of the hole.

What is claimed is:

1. An opening arrangement in a packing container wall comprising:

a weakened area formed by two connected lines of weakening, said weakened area defining a tongue movable away from the packing container wall during an opening operation to at least partially define the area of an opening in the packing container wall and movable toward the packing container wall during a re-closing operation to at least partially reclose the opening, and a cover strip positioned over said tongue and sealed to the packing container wall around the weakened area, the area of the opening being covered from the underside with a thin liquid-tight plastic film which is sealed to the inside of the container, the cover strip being sealed to the plastic film within an area of the opening adjacent said weakened area.

2. The packing container in accordance with claim 1, wherein the seal between the cover strip and the packing container wall is extra strong, or comprises a larger surface, within the area of the tongue as compared to the area surrounding the tongue.

3. The packing container in accordance with claim 1, wherein the cover strip has a free pull-tab.

4. The packing container in accordance with claim 1, wherein the weakened area consists of perforations in the packing container wall which are wholly covered from underneath by the plastic film sealed to the inside of the container.

5. The packing container in accordance with claim 4, wherein said perforations consist of holes or slots recurring at regular intervals along two parallel straight lines, the ends of both of which are connected to each other by a hole partially defining the area of said opening.

6. The packing container in accordance with claim 4, wherein said weakened area consists of two straight parallel cut lines arranged in the package wall, the ends of which are directly connected to each other by a hole partially defining the area of said opening.

7. The packing container in accordance with claim 4, wherein said perforation lines include ends remote from the hole which are joined to each other through a crease line arranged in the package wall for facilitating the folding up of the tongue of the wall formed between the perforation lines.

8. The packing container in accordance with claim 6, wherein said parallel cut lines include ends remote from the hole which are joined to each other through a crease line arranged in the package wall for facilitating the folding up of the tongue of the wall formed between the cut lines.

* * * * *